US006352442B1

(12) United States Patent
Kudo

(10) Patent No.: US 6,352,442 B1
(45) Date of Patent: Mar. 5, 2002

(54) CONNECTOR IN WHICH A FPC IS TIGHTLY HELD BETWEEN A HOUSING AND A MOVABLE ACTUATOR WITH BEING CONNECTED TO THE CONNECTOR

(75) Inventor: Takaaki Kudo, Akishima (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/632,871

(22) Filed: Aug. 4, 2000

(30) Foreign Application Priority Data

Aug. 17, 1999 (JP) ..... 11-230376

(51) Int. Cl.[7] ..... H01R 12/28
(52) U.S. Cl. ..... 439/260; 439/329; 439/495
(58) Field of Search ..... 439/495, 329, 439/260

(56) References Cited

U.S. PATENT DOCUMENTS 4,630,874 A 12/1986 Renn et al.
4,718,859 A * 1/1988 Gardner ..... 439/329
5,928,027 A * 7/1999 Kusnishi ..... 439/495
6,056,572 A * 5/2000 Matsumoto et al. ..... 439/260

FOREIGN PATENT DOCUMENTS

JP 9-82427 3/1997 ..... H01R/23/66

OTHER PUBLICATIONS

Ryuichi Takayasu: "FH12 Connector Series for FPCS, FFCS Increases Circuit Design Freedom", Jee Journal of Electronic Engineering, JP, Dempa Publications Inc., Tokyo; vol. 32, No. 345; Sep. 1, 1995, pp. 31–33, XP000526630; ISSN: 0385–4507; (figures 1–3).

* cited by examiner

*Primary Examiner*—Tho D. Ta
*Assistant Examiner*—Sun McCamey
(74) *Attorney, Agent, or Firm*—Michael Best & Friedrich LLC; J. Warren Whitesel

(57) ABSTRACT

In a connector for use in connecting a FPC having a plurality of pads, a plurality of contacts (16, 17) are held by a housing (15) and become in contact with the pads, respectively. The FPC is tightly held between the housing and an actuator (18) which has a pivot portion (18*c*) pivotally held to the housing and a locking portion (18*e*) making engagement with the housing in a state of tightly holding the FPC. The locking portion is spaced from the pivot portion with a first distance. The first distance is determined greater than a second distance which is determined between the pivot portion and a distal edge (18*d*) of the actuator.

6 Claims, 6 Drawing Sheets

CONNECTOR IN WHICH A FPC IS TIGHTLY HELD BETWEEN A HOUSING AND A MOVABLE ACTUATOR WITH BEING CONNECTED TO THE CONNECTOR

BACKGROUND OF THE INVENTION

The present invention relates to a connector for a flexible printed circuit (hereinafter referred to as "FPC") and more particularly to a connector for a FPC, which is suitable for a high density packaging on a printed circuit board.

A conventional connector for a FPC disclosed in Japanese Unexamined Patent Publication (JP-A) No. H09-82427 will be described with reference to FIGS. 1 through 4. As shown in FIG. 1, a housing 15 includes a base portion 20 and side walls 21 disposed both ends of the base portion 20 and is configured to have an open top. The base portion 20 is provided with a large number of slits 20*a* formed in the front side and a large number of slits 20*b* formed in the rear side.

As shown in FIGS. 1, 2A, and 2B, first contacts 16 are inserted into the slits 20*a* at the front side of the housing 15 and second contacts 17 are inserted into the slits 20*b* at the rear side of the housing 15. Each of the first contacts 16 includes a contact portion 16*a,* a fixing portion 16*b,* and a lead terminal portion 16*c* projecting outside the housing 15.

As shown in FIG. 3A, in the state that the first contacts 16 are inserted into the housing 15, the contact portion 16*a* and fixing portion 16*b* which form together a U-like section vertically sandwich a convex portion 20*c* projecting toward the front of the housing 15. The each first contact 16 further has a contact point 16*d* which is provided on an end portion of the contact portion 16*a* so that the contact point 16*d* is in contact with a pad of a FPC 19 for electric continuity. In the state that the first contacts 16 are inserted into the housing 15, the bottom level of the fixing portion 16*b* and the bottom level of the lead terminal portion 16*c* are flush with the bottom level of the housing 15.

As shown in FIG. 3B, each of the second contacts 17 comprises a contact portion 17*a,* a fixing portion 17*b,* and a lead terminal portion 17*c* and further comprises a spring supporting portion 17*e* positioned above the contact portion 17*a.* As shown in FIG. 3B, in the state that the second contacts 17 are inserted into the housing 15, the contact portion 17*a* and fixing portion 17*b* vertically sandwich a convex portion 20*d* projecting toward the rear of the housing 15. The end portion of the spring supporting portion 17*e* is in a generally curved shape and this portion supports an actuator or a lever 18 described later. The each second contact 17 further has a contact point 17*d* which is provided on an end portion of the contact portion 17*a* so that the contact point 16*d* is in contact with a pad of a FPC 19 for electric continuity. In the state that the second contacts 17 are inserted into the housing 15, the bottom level of the fixing portion 17*b* and the bottom level of the lead terminal portion 17*c* are the same as the bottom level of the housing 15.

In the state that the first and second contacts 16, 17 are inserted into the housing 15, the contact portions 16*a,* 17*a* are aligned to alternate to each other in the width direction of the housing without overlapping. Therefore, the contact points 16*d,* 17*d* of the first and second contacts 16, 17 are arranged in a zigzag configuration in the longitudinal direction and in the width direction. As shown in FIGS. 3A through 3C, the contact points 16*d,* 17*d* of the first and second contacts 16, 17 and the pivot portion (the ends of the spring supporting portions 17*e*) of the lever 18 are positioned to form together a phantom isosceles triangle.

The lever 18 has a pivot portion 18*c* supported pivotally about the ends of the spring supporting portions 17*e* and is positioned above the housing 15 as shown in FIG. 1. After the FPC 19 is set to a predetermined position above the housing, the lever 18 is pivoted to press and fix the FPC 19. In this state, the lever 18 functions as a lid of the housing 15. As shown in FIGS. 3A through 3C, there is a curved engaging portion 18*a* at the pivot portion of the lever 18. The engagement between the engaging portion 18*a* and the ends of the spring supporting portions 17*e* of the second contacts 17 allows the pivotal movement of the lever 18 about the ends of the spring supporting portions 17*e.* When the lever 18 is open (FIGS. 3A and 3B), the contact portion of the lever 18 relative to the FPC 19 is formed in a generally curved configuration. When the lever 18 is closed (FIG. 3C), the contact portion of the lever 18 relative to the FPC 19 is formed like a flat surface.

As shown in FIG. 1, the opposite side walls of the lever 18 are provided with convex portions 18*b* near the ends thereof. When the lever 18 pivots about the ends of the spring supporting portions 17*e* and becomes lie down, the convex portions 18*b* are fitted or engaged into concave portions 21 a formed in inside faces of the side walls 21 of the housing 15 to hold the lever 18 in closing state.

On the other hand, as shown in FIG. 4, a number of contact pads 22*a,* 22*b* are provided on the bottom surface of the FPC 19 so that these contact pads 22*a,* 22*b* are aligned to alternate to each other in two lines of zigzag configuration. The contact pads 22*a* near a head edge of the FPC 19 come into contact with the contact points 17*d* of the second contacts 17 while the contact pads 22*b* far from the head edge of the FPC 19 come into contact with the contact points 16*d* of the first contacts 16.

Since the conventional connector for a FPC described in the above with reference to FIGS. 1 through 4 has the lever 18 which is structured to pivot for the opening and closing movement relative to the housing 15, there is a possibility that the lever 18 is inadvertently opened when the FPC 19 is pulled with force exceeding a predetermined value in a direction of opening the lever 18.

As described concretely, the distance between the pivot portion of the lever 18 (the ends of the spring supporting member 17*e* of the second contact 17) and the concave portions 21*a,* formed on the opposite side walls 21 of the housing 15, to be engaged with the convex portions 18*b* of the lever 18, is shorter than the distance between the pivot portion of the lever 18 and a portion where tensile force in such a direction that the FPC 19 opens the lever 18 acts (the edge of the lever 18 far from the pivot portion of the lever 18), so when the FPC 19 is pulled in the direction of opening the lever 18, the lever 18 may be opened even with small force.

SUMMARY OF THE INVENTION

It is therefore an object of the present invention to provide a connector for a FPC in which an actuator is hard to open even when the FPC is pulled in a direction of opening the actuator.

Other objects of the present invention will become clear as the description proceeds.

According to an aspect of the present invention, there is provided a connector for being connected to a FPC having a plurality of pads, the connector comprising a plurality of contacts for becoming in contact with the pads, respectively, a housing holding the contacts, and an actuator for holding the FPC in cooperation with the housing, the actuator including a pivot portion pivotally held to the housing and a locking portion spaced from the pivot portion with a first distance, the housing having a receiving portion for making engagement with the locking portion in a state of tightly holding the FPC, the actuator further including a particular portion received with release force of the engagement from the FPC, the particular portion being spaced from the pivot portion with a second distance therebetween, the first distance being determined greater than the second distance.

According to another aspect of the present invention, there is provided a connector for being connected to a FPC having a plurality of pads, the connector comprising a plurality of contacts for becoming in contact with the pads, respectively, a housing holding the contacts, an actuator for holding the FPC in cooperation with the housing, the actuator including a pivot portion pivotally held to the housing, a locking portion connected to the actuator and spaced from the pivot portion with a first distance, and a receiving portion connected to the housing for making engagement with the locking portion in a state of tightly holding the FPC, the actuator including a particular portion received with release force of the engagement from the FPC, the particular portion being spaced from the pivot portion with a second distance, the first distance being determined greater than the second distance.

DESCRIPTION OF THE PREFERRED EMBODIMENT

Figure 1:
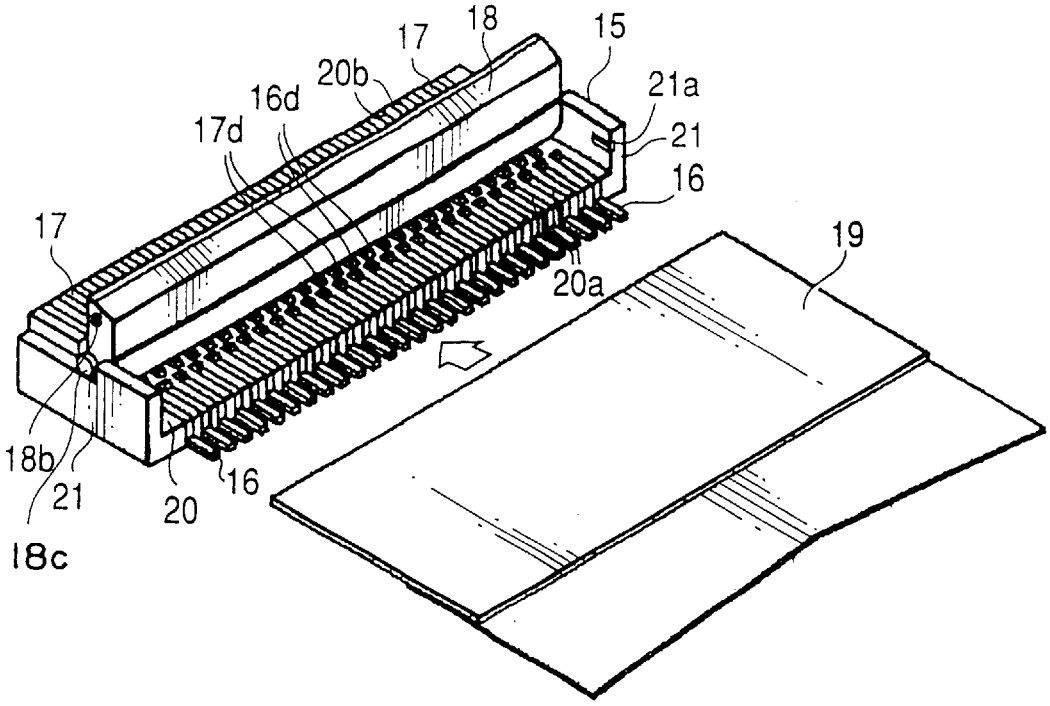
FIG. 1 PRIOR ART
FIG. 1 is a perspective view of a conventional connector for a FPC in a state before the FPC is inserted into the connector.
Figure 2A:
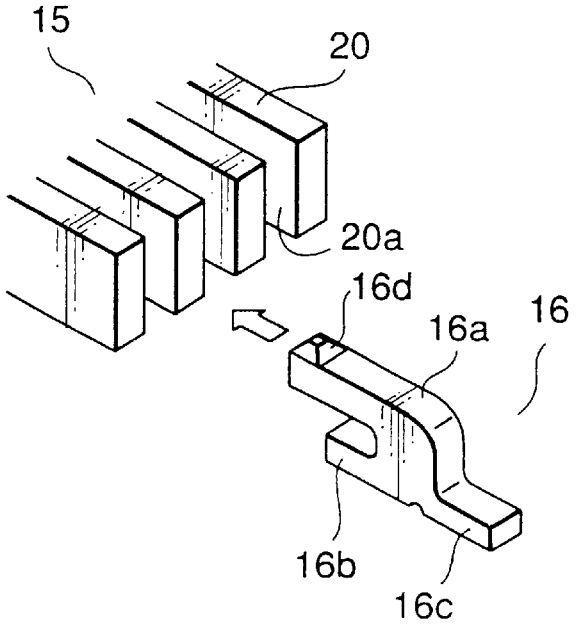
FIG. 2A PRIOR ART
FIG. 2A is a perspective view of the connector shown in FIG. 1 in a state before first contacts are inserted into a housing.
Figure 2B:
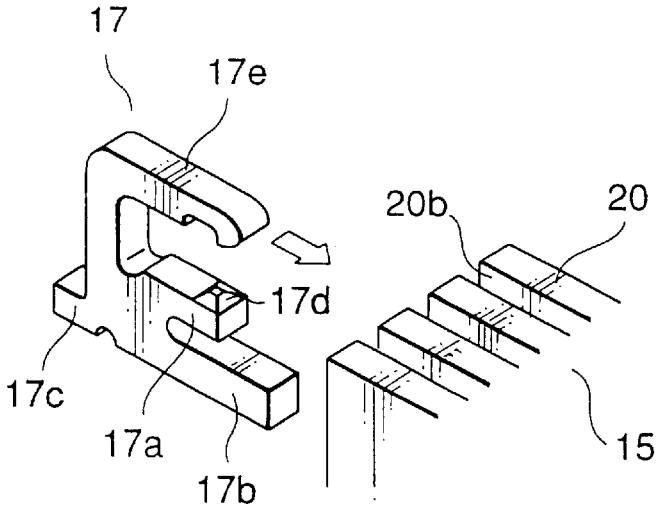
FIG. 2B PRIOR ART
FIG. 2B is a perspective view of the connector shown in FIG. 1 in a state before second contacts are inserted into the housing.
Figure 3A:
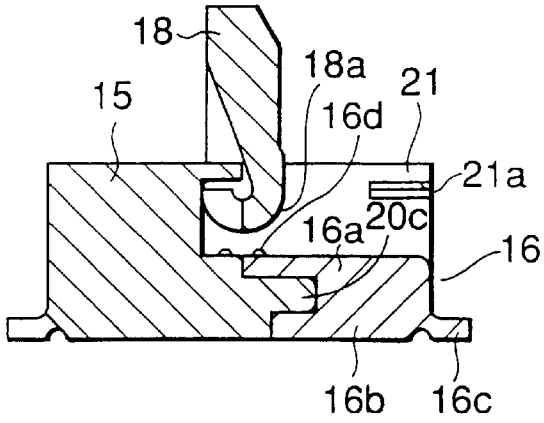
FIG. 3A PRIOR ART
FIG. 3A is a sectional view illustrating a positional relation in the connector of FIG. 1 among the housing, the first contacts, and the lever in the open state.
Figure 3B:
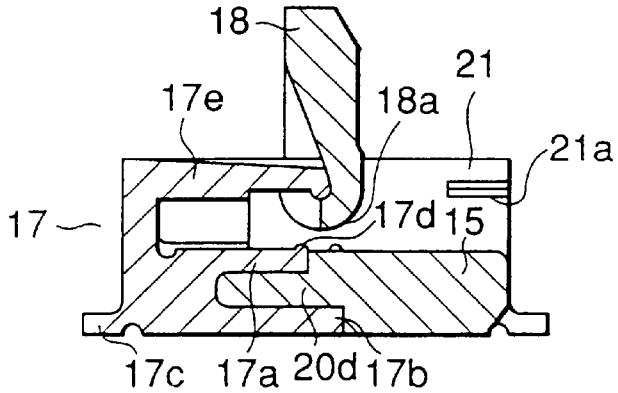
FIG. 3B PRIOR ART
FIG. 3B is a sectional view illustrating a positional relation in the connector of FIG. 1 among the housing, the second contacts, and the lever in the open state.
Figure 3C:
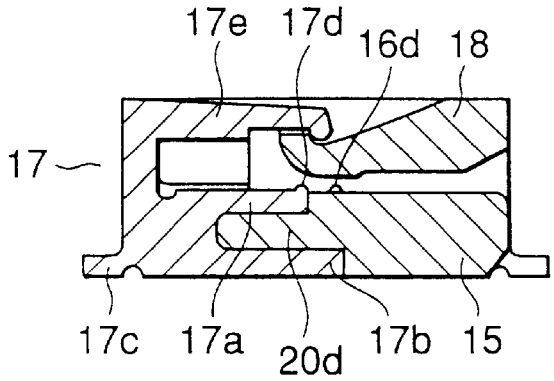
FIG. 3C PRIOR ART
FIG. 3C is a sectional view illustrating a positional relation in the connector of FIG. 1 among the housing, the second contacts, and the lever in the closed state.
Figure 4:
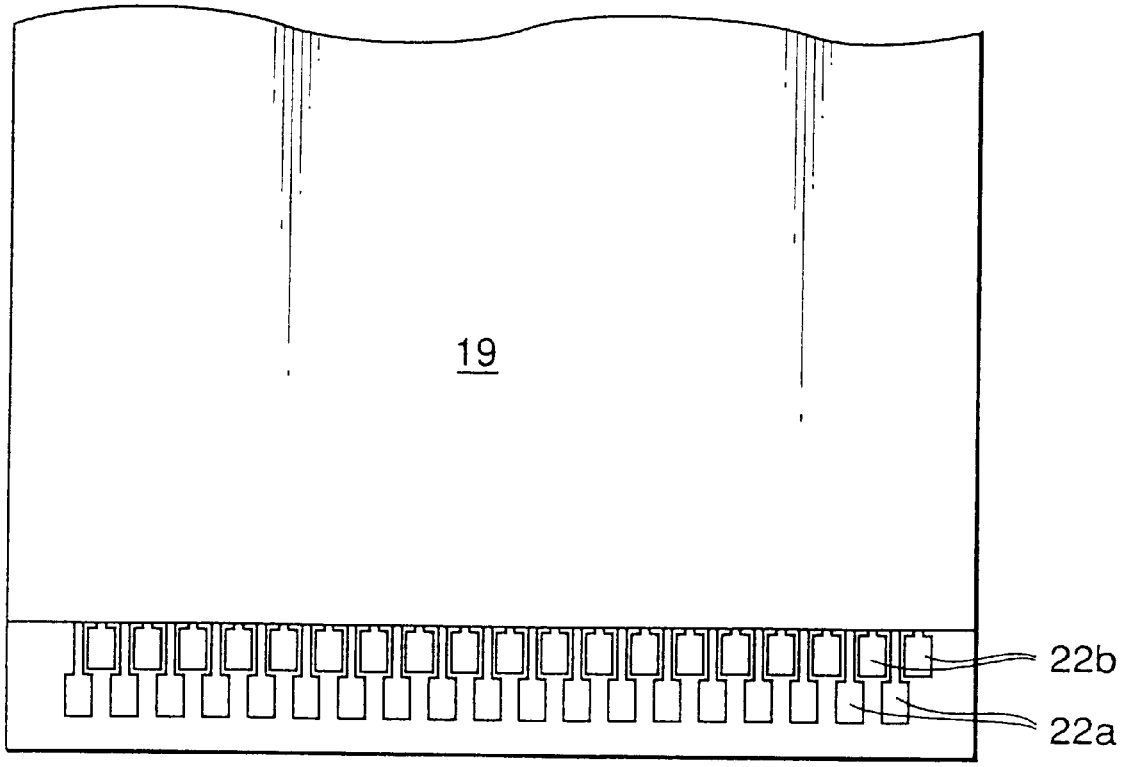
FIG. 4 PRIOR ART
FIG. 4 is a rear view of the FPC to be connected to the connector of FIG. 1.
Figure 5:
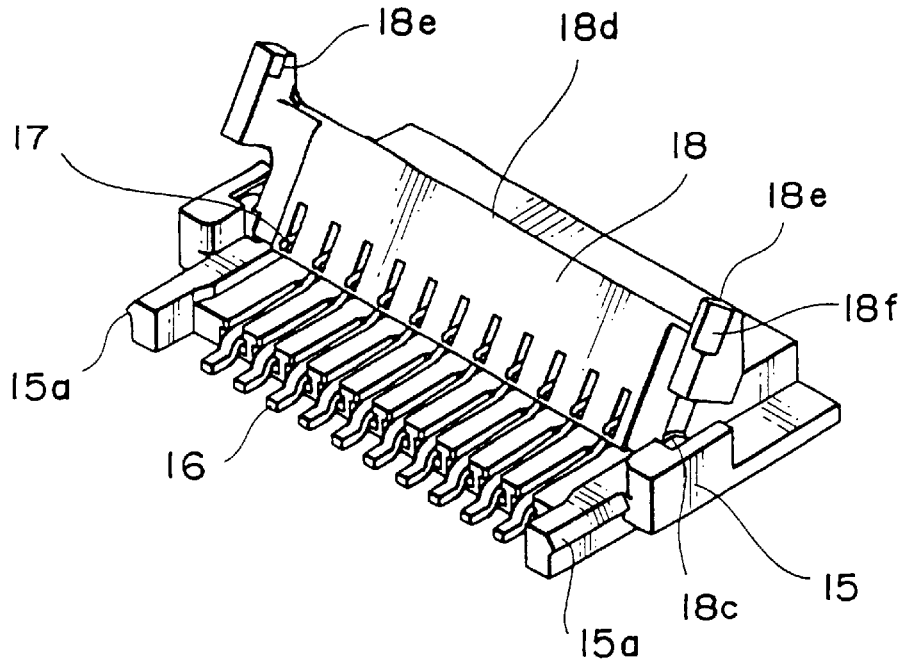
FIG. 5 is a perspective view showing a connector for a FPC according to an embodiment of the present invention in a state that an actuator is opened.
Figure 6:
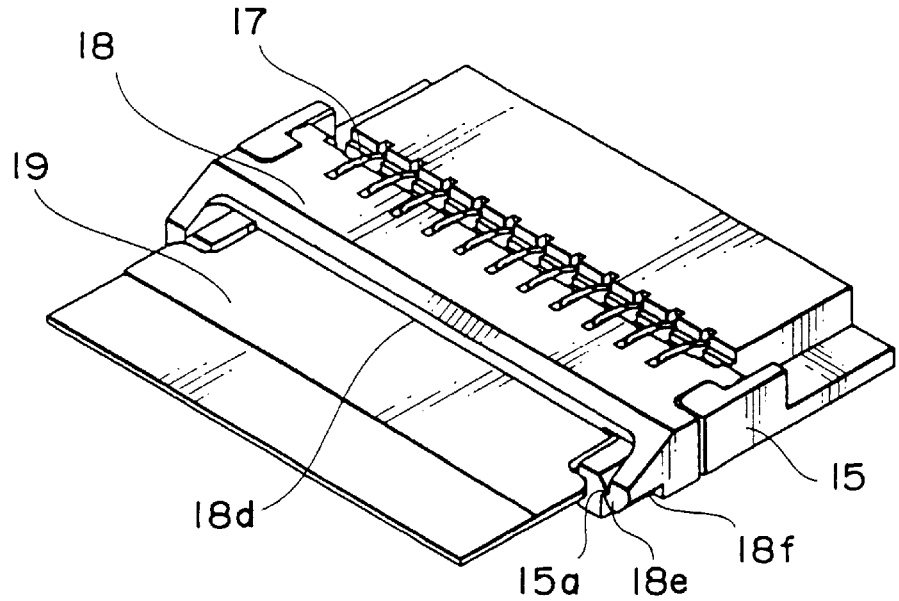
FIG. 6 is a perspective view showing a state that the FPC is inserted into the connector of FIG. 5 and is locked.
Figure 7:
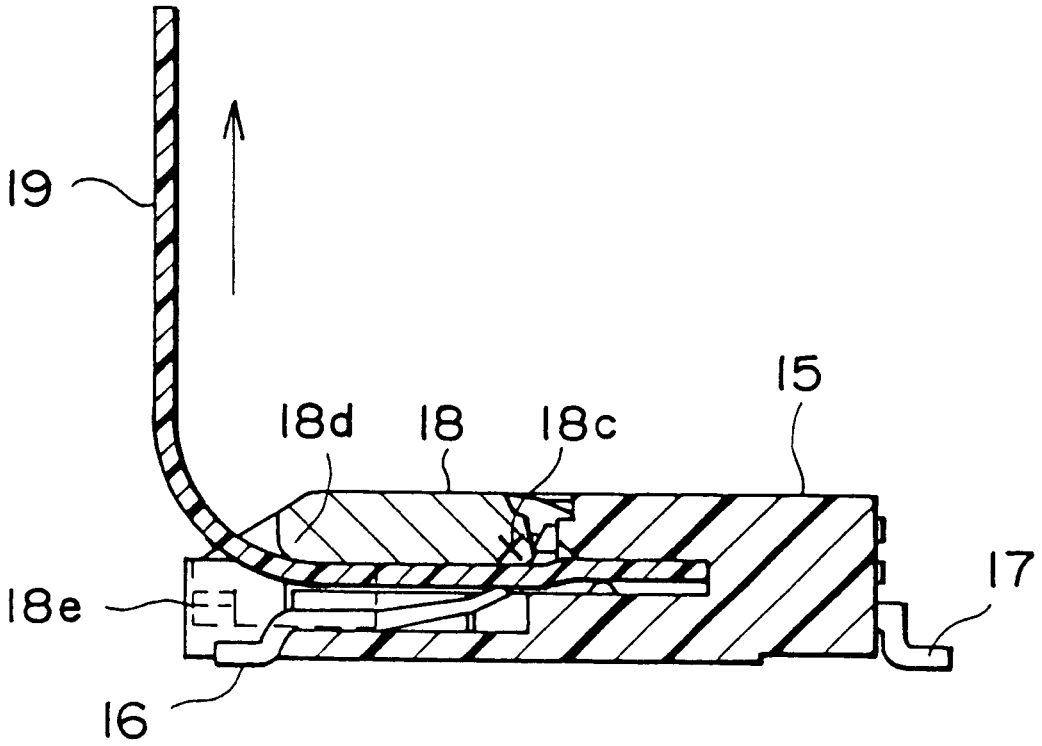
FIG. 7 is a sectional view showing the connector of FIG. 5 in a state that the FPC is pulled in a direction of opening the actuator.

With reference to FIGS. 5 through 7, description will be made as regards a connector according to an embodiment of the present invention. Similar parts are designated by like reference numerals.

First referring to FIG. 5, the connector is for being connected to the FPC 19. Though the structure for attaching the actuator 18 in such a manner as to freely open and close is not illustrated, such attachment can be achieved by fitting or engagement between convex portions formed on outer surfaces of the opposite side walls of the actuator 18 and concave portions formed in inner surfaces of the opposite side walls of the housing 15. Each of the housing 15 and the actuator 18 is made of synthetic resin.

A large number of first contacts 16 are arranged at the front side of the housing 15 and a large number of second contacts 17 are arranged at the rear side of the housing 15. Each of the first and second contacts 16 and 17 is made of conductive material.

As shown in FIG. 5, but not clearly, the first contacts 16 and the second contacts 17 are arranged in a zigzag configuration to prevent mutual short. The housing 15 is provided with receiving portions 15*a* formed on the opposite side walls near the front edge thereof so as to project outwardly.

The actuator 18 comprises a distal edge 18*d* as a particular portion. The actuator 18 is provided with locking portions 18*e* which engage with the receiving portions 15*a,* respectively. The locking portions 18*e* are formed on projections projecting from the opposite sides of the distal edge 18*d* in such a manner as to project inwardly from the projections. The actuator 18 further comprises operating portions 18*f* formed to face outwardly in portions corresponding to the locking portions 18*e*. The actuator 18 can be opened when the operating portions 18*f* are hooked and pulled by fingers. It is to be noted that the locking portions 18*e* are spaced from the pivot portion 18*c* with a first distance, that the distal edge 18*d* is spaced from the pivot portion 18*c* with a second distance, and that the operating portion 18*f* is spaced from the pivot portion 18*c* with a third distance. In the connector, the operating portions 18*f* are formed adjacent to the locking portions 18*e*. In other words, third distance is determined substantially equal to the first distance.

Shown in FIG. 6 is the sate that the FPC 19 is inserted into the connector and locked. In this state, the locking portions 18*e* of the actuator 18 are engaged with a pair of receiving portions 15*a* of the housing 15 in a direction of opening the actuator 18. Therefore, the FPC 19 is tightly held between the housing 15 and the actuator 18 by engagement between locking portions 18*e* and the receiving portions 15*a*.

It should be noted that a large number of contact pads (not shown) are provided on the bottom surface of the FPC 19 so that these contact pads are aligned to alternate to each other in two lines of zigzag configuration. The contact pads near a head edge of the FPC 19 come into contact with the second contacts 17 while the contact pads far from the head edge of the FPC 19 come into contact with the first contacts 16.

Referring to FIG. 7, when the FPC 19 is pulled in the direction of opening the actuator 18, the actuator 18 is subjected to load at the distal edge 18*d*. Taking this into consideration, the distance between the locking portions 18*e* and the pivot portion 18*c* of the actuator 18 is set to be longer than the distance between the distal edge 18*d* of the actuator 18 and the pivot portion 18*c*. In other words, the first distance is determined greater than the second distance. Accordingly, even when the FPC 19 is inadvertently pulled in the direction of arrow, the engagement between the locking portions 18*e* and the receiving portions 15*a* is hardly released because of the leverage.

While the present invention has thus far been described in connection with a single embodiments thereof, it will readily be possible for those skilled in the art to put this invention into practice in various other manners. For example, the operating portions are formed in position farther from the pivot portion relative to the locking portions of the actuator. In other words, the third distance is determined greater than the first distance. With this structure, the actuator can be opened from the housing even with small force.

What is claimed is:

1. A connector for being connected to a FPC having a plurality of pads, said connector comprising:

a plurality of contacts for coming into contact with said pads, respectively;

a housing holding said contacts; and an actuator for holding said FPC in cooperation with said housing, said actuator including a pivot portion held to said housing and two locking portions spaced from said pivot portion by a first distance, said housing having a receiving portion for making engagement with said locking portion tightly holding said FPC, said actuator further including a distal edge having said locking portions at opposite ends thereof, said distal edge receiving and resisting a release force which counters said engagement with said FPC and being spaced from said pivot portion by a second distance, said first distance being determined greater than said second distance.

2. A connector as claimed in claim 1, wherein said pivot portion is on an axis extending in a predetermined direction, said receiving portion projecting from each of opposite side walls of said housing in said predetermined direction, said locking portion projecting from each of opposite side walls of said actuator in said predetermined direction.

3. A connector as claimed in claim 1, further comprising an operating portion connected to said actuator for pivotally operating said actuator, said operating portion being spaced from said pivot portion with a third distance.

4. A connector as claimed in claim 3, wherein said third distance is determined substantially equal to said first distance.

5. A connector as claimed in claim 3, wherein said third distance is determined greater than said first distance.

6. A connector for being connected to a FPC having a plurality of pads, said connector comprising:

a plurality of contacts for coming into contact with said pads, respectively;

a housing holding said contacts;

an actuator for holding said FPC in cooperation with said housing, said actuator including a pivot portion held to said housing;

two locking portions connected to said actuator and spaced from said pivot portion by a first distance; and a receiving portion connected to said housing for making engagement with said locking portion tightly holding said FPC, said actuator including a distal edge having said locking portions at opposite ends thereof, said distal edge receiving and resisting a release force which counters said engagement from said FPC, said distal edge being spaced from said pivot portion by a second distance, said first distance being determined greater than said second distance.

* * * * *